US008097144B2

(12) United States Patent
Nguyen et al.

(10) Patent No.: US 8,097,144 B2
(45) Date of Patent: Jan. 17, 2012

(54) ALUMINIUM ELECTROWINNING CELL WITH ENHANCED CRUST

(75) Inventors: Thinh T. Nguyen, Onex (CH); René Von Kaenel, Venthône (CH); Vittorio De Nora, Veyras (CH)

(73) Assignee: Rio Tinto Alean International Limited, Montreal (CA)

( * ) Notice: Subject to any disclaimer, the term of this patent is extended or adjusted under 35 U.S.C. 154(b) by 787 days.

(21) Appl. No.: 12/224,923

(22) PCT Filed: Feb. 26, 2007

(86) PCT No.: PCT/IB2007/050611

§ 371 (c)(1),
(2), (4) Date: Sep. 9, 2008

(87) PCT Pub. No.: WO2007/105125

PCT Pub. Date: Sep. 20, 2007

(65) Prior Publication Data

US 2009/0114547 A1 May 7, 2009

(30) Foreign Application Priority Data

Mar. 10, 2006 (WO) ..... PCT/IB2006/000601

(51) Int. Cl.

| | |
|---|---|
| ***C25C 3/08*** | (2006.01) |
| ***C25C 7/00*** | (2006.01) |
| ***C25C 3/06*** | (2006.01) |
| ***C25C 3/10*** | (2006.01) |

(52) U.S. Cl. ..... 205/380; 205/386; 205/390; 205/396; 204/243.1; 204/245; 204/247.3

(58) Field of Classification Search ..... None
See application file for complete search history.

(56) References Cited

U.S. PATENT DOCUMENTS

| | | | | |
|---|---|---|---|---|
| 4,956,068 | A * | 9/1990 | Nguyen et al. | 205/350 |
| 5,368,702 | A * | 11/1994 | de Nora | 205/373 |
| 5,415,742 | A * | 5/1995 | La Camera et al. | 205/336 |
| 6,402,928 | B1 * | 6/2002 | de Nora et al. | 205/389 |
| 6,656,340 | B2 * | 12/2003 | de Nora et al. | 205/389 |
| 6,818,106 | B2 * | 11/2004 | D'Astolfo et al. | 204/243.1 |
| 2001/0035344 | A1 * | 11/2001 | D'Astolfo et al. | 204/243.1 |
| 2003/0209426 | A1 * | 11/2003 | Slaugenhaupt et al. | 204/247.4 |

FOREIGN PATENT DOCUMENTS

| | | |
|---|---|---|
| GB | 1046705 | * 10/1966 |
| WO | WO 02/06565 | * 1/2002 |
| WO | WO 02/070784 | * 9/2002 |
| WO | WO 02/097168 | * 12/2002 |
| WO | WO 03/102274 | * 12/2003 |
| WO | WO 2004/074549 | * 9/2004 |
| WO | WO 2006/007863 | * 1/2006 |

* cited by examiner

*Primary Examiner* — Harry D Wilkins, III
(74) *Attorney, Agent, or Firm* — Jayadeep R Deshmukh

(57) ABSTRACT

A cell for the electrowinning of aluminium has a cavity for containing electrolyte (20) and one or more non emerging active anode bodies (5) that are suspended in the electrolyte. The electrolyte's surface (21,21') has an expanse extending over the cavity and is substantially covered by a self-formed crust (25) of frozen electrolyte. The crust is mechanically reinforced by at least one preformed refractory body (30, 30',30"). The electrolyte crust is formed against the pre-formed refractory body and bonded thereto so as to inhibit mechanical failure of the crust and collapse of the crust into the cavity.

26 Claims, 1 Drawing Sheet

ALUMINIUM ELECTROWINNING CELL WITH ENHANCED CRUST

FIELD OF THE INVENTION

The invention relates to an aluminium electrowinning cell, in particular a cell fitted with non carbon anodes, having an electrolyte with a large open surface covered by crust.

BACKGROUND OF THE INVENTION

The technology for the production of aluminium by the electrolysis of alumina, dissolved in molten cryolite containing salts, at temperatures around 950° C. is more than one hundred years old.

Conventional aluminium production cells are constructed so that in operation a crust of solidified molten electrolyte forms around the inside of the cell sidewalls. At the cell sidewalls, this crust is extended by a ledge of solidified electrolyte which projects inwards over the top of the molten electrolyte. The solid crust in fact extends between large carbon anodes that dip in the molten electrolyte. To replenish the molten electrolyte with alumina in order to compensate for depletion during electrolysis, this crust is broken periodically at selected locations by means of a crust breaker, fresh alumina being fed through the hole in the crust.

This crust/ledge of solidified electrolyte forms part of the cell's heat dissipation system in view of the need to keep the cell in operation at constant temperature despite changes in operating conditions, as when anodes are replaced, or due to damage/wear to the sidewalls, or due to over-heating or cooling as a result of great fluctuations in the operating conditions. In conventional cells, the crust is used as a means for automatically maintaining a satisfactory thermal balance, because the crust/ledge thickness self-adjusts to compensate for thermic unbalances. If the cell overheats, the crust/ledge dissolves partly thereby reducing the thermic insulation, so that more heat is dissipated through the sidewalls leading to cooling of the cell contents. On the other hand, if the cell cools the crust thickens which increases the thermic insulation, so that less heat is dissipated, leading to heating of the cell contents.

The presence of a crust of solidified electrolyte is considered to be important to achieve satisfactory operation of commercial cells for the production of aluminium on a large scale. In fact, the heat balance and energy consumption are major concerns of cell design, since only about 25% of the energy consumed is used for the production of aluminium. Optimization of the heat balance is needed to keep the proper bath temperature and heat flow to maintain a frozen electrolyte layer (side ledge) with a proper thickness.

In conventional cells, the major heat losses occur at the sidewalls, the current collector bars and the cathode bottom, which account for about 35%, 8% and 7% of the total heat losses respectively, and considerable attention is paid to providing a correct balance of these losses. Further losses of 33% occur via the carbon anodes, 10% via the crust and 7% via the deck on the cell sides. This high loss via the anodes is considered inherent in providing the required thermal gradient through the anodes.

It has been suggested to solve this problem by operating the metal-based anode cells without a crust of solidified electrolyte by using a thermal insulation covering the electrolyte, as for instance disclosed in U.S. Pat. Nos. 5,368,702, 6,402,928, 6,656,340, and publications WO02/070784 and WO03/102274 (all assigned to MOLTECH Invent S.A.) as well as in U.S. Pat. No. 5,415,742 (La Camera/Tomaswick/Ray/Ziegler), and Publications WO02/06565 (D'Astolfo/Hornack), US 2001/0035344 (D'Astolfo/Lazzaro) and US 2001/0037946 (D'Astolfo/Moor). US 2003/0209426 (Slaugenhaupt/Kozarek) discloses a ceramic block for use in a crustless cell as a cover element or cell linings made of a sintered mixture of $Al_2O_3$ and at least one of NaF, $AlF_3$, $CaF_2$ and $MgF_2$.

A more conservative approach involves the substitution of emerging carbon anode blocks with anode blocks of similar shape having non-consumable surfaces. U.S. Pat. No. 6,681,106 (D'Astolfo/Bates) discloses massive cermet inert anode blocks protected against thermal shocks and chemical reactants by a soluble solid layer of a mixture of alumina, cryolite and cementitious binder. WO2006/007863 (Ginatta) discloses metal anode blocks for the electrowinning of aluminium that are protected against molten electrolyte and anodically-evolved oxygen by cooling the anodes so as to freeze a skin of electrolyte on the exposed anode surfaces.

Despite previous efforts to develop a cell for operation with the new type of non emerging active anode bodies, there is still a need to provide a covering on the cell's molten electrolyte which is resistant to electrolyte vapours and gases evolved during electrolysis and which has sufficient mechanical resistance.

SUMMARY OF THE INVENTION

The need to modify the covering of the molten electrolyte has increased with the replacement of carbon anodes by advanced metal-based anodes whose main active bodies are fully immersed in the electrolyte and do not emerge and thus do not occupy a large part of the electrolyte's surface. Indeed, these advanced active anode bodies are held immersed in the molten electrolyte by elongated anode stems that emerge from the electrolyte and that do not provide sufficient mechanical support or anchorage for holding a large crust of molten electrolyte so that a crust formed on such cell tends to collapse into the electrolyte. Embodiments of such advanced metal-based anodes comprise an active body having a grid-like or plate-like foraminate structure that is parallel to the facing cathode. See for instance WO00/40781, WO00/40782 and WO03/006716 (all assigned to MOLTECH Invent S.A.).

Therefore, the invention relates to a cell for the electrowinning of aluminium from alumina dissolved in a fluoride-containing molten electrolyte. The cell has a cavity for containing the electrolyte and one or more non emerging active anode bodies that are suspended in the electrolyte. The electrolyte has a surface that has an expanse extending over the cavity and that is substantially covered by a self-formed crust of frozen electrolyte. According to the invention, the crust is mechanically reinforced by at least one preformed refractory body, the electrolyte crust being formed against the preformed refractory body and bonded thereto so as to inhibit mechanical failure of the crust and collapse of the crust into the cavity.

This reinforcing preformed refractory body can be made of ceramic material, in particular an inert and resistant ceramic material that comprises at least one oxide selected from oxides of aluminium, zirconium, tantalum, titanium, silicon, niobium, magnesium and calcium and mixtures thereof, as a simple oxide and/or in a mixed oxide, for example an aluminate of zinc ($ZnAlO_4$) or titanium ($TiAlO_5$). Other suitable inert and resistant ceramic materials can be selected amongst nitrides, carbides and borides and oxycompounds, such as aluminium nitride, AlON, SiAlON, boron nitride, silicon nitride, silicon carbide, aluminium borides, alkali earth metal zirconates and aluminates, and their mixtures. To reduce the risk of contamination of the cell's electrolyte and the electrowon aluminium, the ceramic material can be an alumina-based material.

A reinforcing preformed refractory body may have a ceramic structure with an open porosity containing a filler such as frozen electrolyte infiltrated into the structure. This structure may be porous throughout or have a solid substrate with an openly porous outer part, in particular the part that faces the molten electrolyte during use. The porosity can be in the range of 5 to 30 ppi (pores per inch). The openly porous preformed refractory body can be made substantially impervious to gas, in particular electrolyte vapours, by the electrolyte infiltrated into the body and frozen therein.

For example, this infiltrated frozen electrolyte is made of a mixture containing aluminium fluoride and sodium fluoride, in particular a mixture having a melting point above 960° C.

At least one reinforcing preformed refractory body forms part of a means to suspend the self-formed electrolyte crust over the molten electrolyte. For example, one or more sidewalls can support such preformed refractory body over the cavity, and/or such body may be supported by a stem, in particular by an anode stem. A reinforcing preformed refractory body can be in the shape of an elongated plate-like body and optionally extend along a cell sidewall or centrally along the cell. A preformed refractory body may also be in the form of a generally rectangular or round plate and, for example, suspended by an anode stem or a suspension rod over the molten electrolyte.

The frozen electrolyte crust can be spaced over the electrolyte surface by a gap that is formed by removing molten electrolyte upon formation of the crust thereon. Such gap is useful for the collection of gas produced during electrolysis.

The invention also relates to a trough for the electrowinning of aluminium from alumina dissolved in a fluoride-containing molten electrolyte. The trough has a cavity for containing the electrolyte. The electrolyte has a surface that has an expanse extending over the cavity and that is substantially covered by a self-formed crust of frozen electrolyte. The crust is mechanically reinforced by at least one openly porous preformed refractory body made of a ceramic structure infiltrated with frozen electrolyte. The electrolyte crust is formed against the preformed refractory body and bonded thereto so as to inhibit mechanical failure of the crust and collapse of the crust into the cavity. The trough may incorporate any of the above mentioned cell features or combination of features.

Another aspect of the invention relates to a method of forming a crust on a molten electrolyte contained in an aluminium electrowinning cell or trough as described above. The method comprises providing at least one reinforcing preformed refractory body, bringing the refractory body into contact with the surface of the electrolyte and freezing the surface of the molten electrolyte so as to form a crust in which the preformed refractory body is sealed to reinforce the crust.

Upon freezing, the reinforcing body may be incorporated within the crust.

At least one reinforcing preformed refractory body that is openly porous can be infiltrated with frozen electrolyte before contacting the electrolyte contained in the cell, in particular with an electrolyte having a melting point above the operating temperature of the electrolyte contained in the cell. An openly porous preformed refractory body may be infiltrated with electrolyte contained in the cell upon contact therewith, the electrolyte contained in the cell having a melting point that is optionally lowered upon infiltration of the refractory body, for example by adding aluminium fluoride and/or potassium fluoride into the electrolyte.

Upon formation of the crust, a gap can be provided between the surface of the electrolyte and the crust. Such gap can be formed by removal of molten electrolyte or tapping of product aluminium without full compensation with molten electrolyte and/or alumina.

A further aspect of the invention relates to a method of producing aluminium that comprises: providing an electrolyte in an aluminium electrowinning cell; forming a crust on the electrolyte by the method described above; supplying alumina to the electrolyte, in particular through the crust, where it is dissolved; electrolysing the dissolved alumina to produce gas anodically, in particular oxygen on a metal-based anode, and aluminium cathodically; tapping product aluminium, in particular through a hole in the crust or in at least one reinforcing preformed refractory body.

BRIEF DESCRIPTION OF THE DRAWING

The invention will be further described with reference to the accompanying schematic drawings in which.

DETAILED DESCRIPTION

Figure 1:
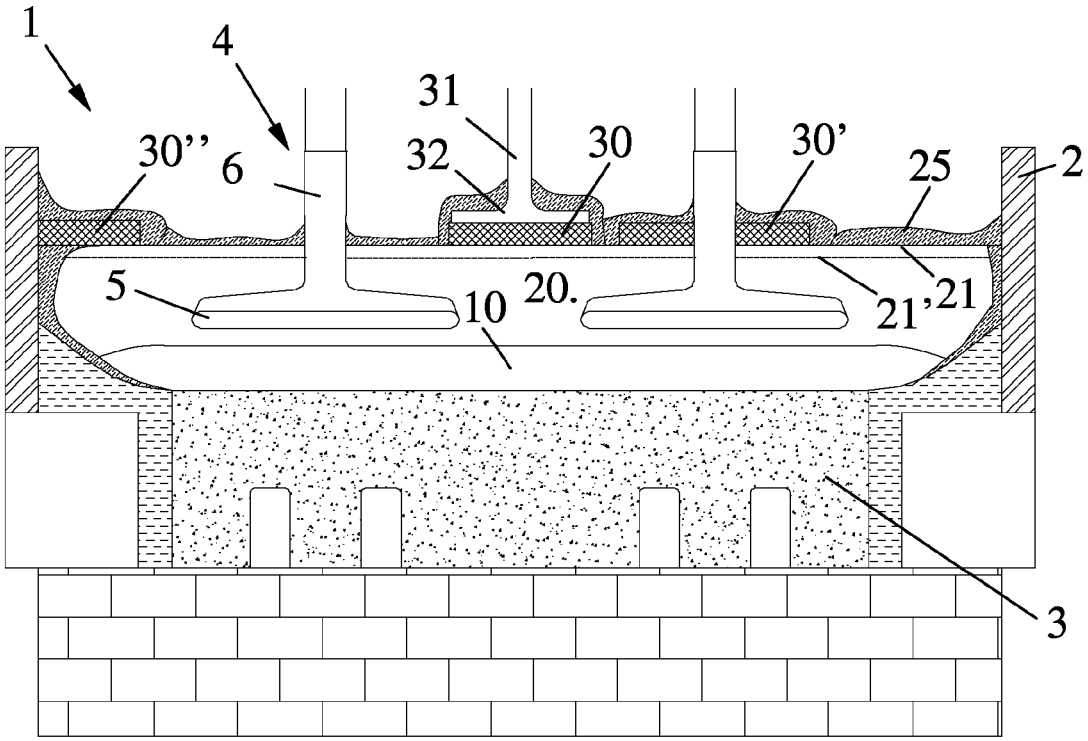
FIG. 1 schematically shows a cross-section of a cell according to the invention.
Figure 2:
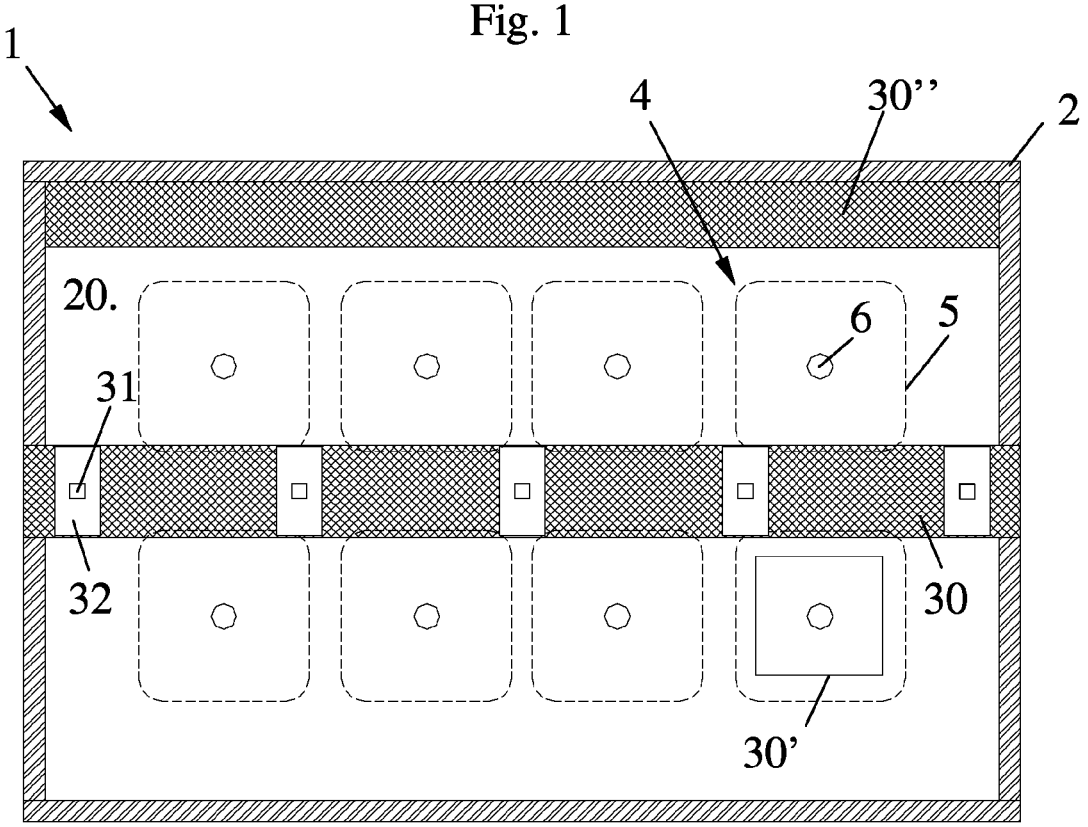
FIG. 2 shows a plan view underneath the crust of the cell illustrated by FIG. 1.

FIGS. 1 and 2 show an aluminium electrowinning cell 1 for the electrowinning of aluminium 10 from alumina dissolved in a fluoride-containing molten electrolyte 20.

The cell 1 has a trough formed by sidewalls 2 and a cathodic cell bottom 3 which delimit a cavity for containing electrolyte 20 and product aluminium 10.

The cathodic bottom 3 can have a surface made of any suitable aluminium-wettable material that is resistant to the cell operating conditions, in particular to molten aluminium and electrolyte at high temperature. Bottom 3 can include a layer of carbon cathode blocks covered with an aluminium-wettable refractory material such as a titanium diboride or other boride based layer, or of a ceramic body made of aluminium-wettable material. The aluminium-wettable material advantageously includes one or more wetting agents, such as oxides of iron, copper and/or nickel. Examples of such materials are disclosed in U.S. Pat. Nos. 5,364,513, 5,651,874, 6,436,250, and in PCT publications WO01/42168, WO01/42531, WO02/070783, WO02/096830 and in PCT Publications WO02/096831, WO2004/092449 and WO2005/068390 (all assigned to MOLTECH Invent S.A.).

The same aluminium-wettable material can advantageously be used to make or coat sidewalls 2. The sidewalls 2 can also be made of or coated with silicon carbide, silicon nitride and/or other known materials.

Electrolyte 20 can in particular contain a mixture of aluminium fluoride and sodium fluoride possibly including one or more additives such as potassium, calcium, magnesium and lithium fluorides. The temperature of electrolyte 20 is normally in a range from above the melting point of aluminium to 1000° C., usually above 700 or 750° C. and below 985 or 970° C. Typically, the temperature is in a range from 860 to 960° C. such as 900° to 950° C. Suitable electrolytes are disclosed in U.S. Pat. Nos. 5,725,744, 6,372,099, 6,521,116, and in PCT publications WO01/42535, WO02/097167, WO2004/035871 and WO2004/074549 (all assigned to MOLTECH Invent S.A.)

Anodes 4 are suspended in electrolyte 20. The anodes 4 comprise an oxygen-evolving active anode body 5 that is fully immersed in the molten electrolyte 20 and that is held over and parallel to the cathodic bottom 3 by a stem 6. Thus unlike less advanced cells operating with anode blocks for example made of carbon, ceramic or cermet material, anode bodies 5 do not emerge from the electrolyte 20 and do not provide an anchorage for holding an electrolyte crust.

Suitable advanced anode designs and operation therewith can be found in co-pending applications WO99/02764, WO00/40781, WO00/40782, WO03/006716 and WO2005/118916 (all assigned to MOLTECH Invent S.A.), which show active anode structures fully immersed in a molten electrolyte, and suspended from an electrically conductive stem which is partly immersed in the molten electrolyte, the stem feeding to the active structure current from a current source via a busbar in the cell superstructure. However, other anode configurations may also be used, such as configurations disclosed in U.S. Pat. Nos. 5,362,366 and 6,797,148 and in PCT publication WO93/25731 (all assigned to MOLTECH Invent S.A.).

Suitable materials which could be used as electrochemically active anode materials are disclosed in U.S. Pat. Nos. 6,077,415, 6,103,090, 6,113,758, 6,248,227, 6,361,681, 6,365,018, 6,379,526, 6,521,115, 6,562,224, 6,878,247 and PCT publications WO00/40783, WO01/42534, WO02/070786, WO02/083990, WO02/083991, WO03/014420, WO03/078695, WO03/087435, WO2004/018731, WO2004/024994, WO2004/044268, WO2004/050956, WO2005/090641, WO2005/090642 and WO2005/090643 (all assigned to MOLTECH Invent S.A.). Stem 6 can be made of the same materials or, advantageously, of the stem material disclosed in WO2004/035870 (assigned to MOLTECH Invent S.A.)

The electrolyte 20 has a surface 21 with an expanse that extends over the cavity and that is substantially covered by a self-formed crust of frozen electrolyte 25. As indicated above, crust 25 is not formed between anode bodies 5 and is thus not anchored therebetween.

To reinforce the mechanical stability of crust 25 and avoid failure (collapse) thereof, the crust 25 is mechanically reinforced by preformed refractory bodies 30,30',30" which are made of an alumina-based structure infiltrated with frozen electrolyte.

The electrolyte crust 25 is formed against the preformed refractory bodies 30,30',30" and bonded thereto and supported thereby so as to inhibit mechanical failure of the crust 25 and its collapse into the molten electrolyte 20.

Three different kind of refractory bodies 30,30',30" are shown in FIGS. 1 and 2. Refractory body is shaped as an elongated plate extending centrally along cell 1. This body 30 can rest on sidewalls 2 and/or be held over electrolyte 20 by suspension rods 31 via foot 32, as shown in FIG. 2. Rods 31 and feet 32 can be made of the same materials as stems 6. Body 30' has the shape of a generally rectangular plate held by anode stem 6. Plate 30' can be arranged so as to be removable with anode 4. Refractory body 30" is shaped as an elongated plate extending laterally along the cell 1. This body 30" can be secured against sidewalls 2. bodies 30,30' can be bonded against foot 32 and anode stem 6 for example with electrolyte.

The refractory bodies 30,30',30" can cover between 30 and 95% of the electrolyte surface 21, in particular 60 to 85% thereof.

At the start-up of the cell 1 shown in FIGS. 1 and 2, the crust 25 is formed by freezing the surface 21 of electrolyte 20. Electrolyte 20 freezes around refractory bodies 30,30',30" which are then bonded against crust 25 and form a mechanical support therefor. By contacting (cold) bodies 30,30',30", electrolyte 20 starts to freeze thereagainst so that crust 25 begins its formation on bodies 30,30',30", which act as crust starters, crust reinforcing elements and crust supporting elements.

Upon formation of crust 25, the level of electrolyte 20 can be lowered so as to form a small gap between crust 15 and electrolyte surface 21 as indicated in FIG. 1 by the doted line 21'. This gap is useful for the evacuation of gas produced during electrolysis and can be formed by removal of a small amount of electrolyte 20 after formation of crust 25, by evaporation of electrolyte 20 or by tapping product aluminium 10 without full compensation with additional electrolyte and/or alumina.

During normal cell operation, alumina dissolved in electrolyte 20 is electrolysed between anode bodies 5 and cathodic cell bottom 3 to produce aluminium 10 cathodically and oxygen anodically.

The invention will be further described in the following Example.

Example 1

A preformed refractory body made of an alumina-based structure infiltrated with frozen electrolyte suitable to be used to support the electrolyte crust of a cell according to the invention was prepared as follows:

A generally rectangular plate of openly porous alumina was made by dipping into an alumina-based slurry a foam of polyethylene having a length and a width of 70×70 cm and a thickness of 5 cm and an open porosity of 10 ppi (pores per inch). This alumina-based slurry contained an amount of between 30 and 40 wt % alumina cement powders VULCANSIL HJC-11 (VULCAN-UK), the balance being water. Upon impregnation, the foam was dried at about 150-160° C. for approximately 30 minutes. Thereafter, these impregnation and drying steps were repeated two more times. In a variation, it is possible to use a honeycomb-type structure.

After these three impregnation and drying cycles, the foam with the cement was brought to a baking temperature of 800° C. at a heating rate of 150° C./hour. After two hours at the baking temperature the consolidated alumina structure was left in the oven and allowed to cool down to room temperature. In a variation, baking can be followed by sintering at 1100° C. for 2 hours.

During the baking step the polyethylene structure was burned away so that the remaining structure contained at least 98 wt % alumina with an open porosity of about 10 ppi. This structure had a volume density of about 35% (65% void) and an apparent mass density in the range of 1.2 to 1.3 g/cm$^3$.

This alumina structure is suitable to be used to make, upon impregnation with electrolyte, a preformed refractory body for reinforcing the frozen electrolyte crust of an aluminium electrowinning cell.

Example 2

An openly porous alumina structure produced by the process described in Example 1 was placed flat on a metallic working surface and impregnated with a molten electrolyte made of NaF and $AlF_3$ corresponding to the stoichiometry of cryolite $Na_3AlF_6$ (60 w % $NaF_3$+40 w % $AlF_3$) having a melting point of 1100° C.

In a variation, the melting point of the impregnation electrolyte is lowered by the addition of $AlF_3$, $CaF_2$ and/or $Al_2O_3$ to the cryolite composition. For example, a melting point of about 966° C. is obtained with a mixture containing 49.8 w % NaF, 43.2 w % $AlF_3$, 4 w % $CaF_2$ and 3 w % $Al_2O_3$; a melting point of about 957° C. is obtained with a mixture of 48.6 w % NaF, 44.4 w % $AlF_3$, 4 w % $CaF_2$ and 3 w % $Al_2O_3$.

To avoid melting of the frozen impregnation electrolyte during use, its melting point should not be below the temperature of the cell's molten electrolyte during normal operation.

The impregnation of the openly porous alumina structure was achieved by pouring the cryolite melt directly onto the porous alumina structure and allowing the structure to cool down so as to freeze the electrolyte within the pores. A layer of frozen electrolyte having a thickness of about 0.2 to 0.5 mm was formed on the surfaces of the pores of the alumina structure. The mass density of the impregnated structure was of about 1.8 to 1.9 g/cm$^3$. The volume density was of about 65 to 70%. The alumina structure contained approximately 17 kg frozen electrolyte which corresponds to a specific load of 650 to 700 kg electrolyte per cubic meter.

This impregnated alumina structure is suitable to be used as a preformed refractory body made of an alumina-based structure infiltrated with frozen electrolyte in a cell according to the invention, as described in Example 3.

Example 3

An aluminium electrowinning cell having a trough defining a cavity with a length of 300 cm, a width of 200 cm and a depth of 50 cm was equipped with two rows of four metal-based anodes. Each anode had a grid-like active body of 60×60 cm facing the cell's cathodic bottom. The cavity contained 2,500 kg molten electrolyte having a nominal composition of 42.6 w % NaF, 40.4 w % $AlF_3$, 4 w % $CaF_2$, 8 w % KF and 5 w % $Al_2O_3$. This electrolyte had a melting point of about 915° C. and a density of 2.12 g/cm$^3$.

A plurality of preformed refractory alumina plates impregnated with frozen electrolyte as described in Example 2 were placed on the surface of the molten electrolyte. Those plates had a density that was lower than the density of the molten electrolyte and thus floated at the surface of the cell's electrolyte. After 15 minutes, a crust having a thickness between 1 and 2 cm had formed by freezing of the surface of the cell's electrolyte, starting from the impregnated preformed refractory alumina plates. These alumina plates were firmly sealed against the crust of molten electrolyte and mechanically reinforced the crust.

The crust was further reinforced by applying thereon a 1 cm thick layer of a powder mixture containing 70 w % cryolite and 30 w % $Al_2O_3$. Every hour a further layer of this composition was added onto the crust. After 5 such layers had been applied to the crust, a 2 to 3 cm thick layer of alumina powder was put onto this crust to improve the thermal insulation.

Aluminium was produced cathodically by passing an electrolysis current between the anodes and the facing cathodic bottom to electrolyse the alumina dissolved in the molten electrolyte and evolve oxygen anodically.

While the invention has been described in conjunction with specific embodiments and figures, it is evident that many alternatives, modifications, and variations falling within the scope of the appended claims will be apparent to those skilled in the art.

The invention claimed is:

1. A cell for the electrowinning of aluminium from alumina dissolved in a fluoride-containing molten electrolyte, said cell having a cavity for containing the electrolyte and one or more non emerging active anode bodies that are suspended in the electrolyte, the electrolyte having a surface that has an expanse extending over the cavity and that is substantially covered by a self-formed crust of frozen electrolyte, wherein the crust is mechanically reinforced by at least one preformed refractory body, the electrolyte crust being formed against the preformed refractory body and bonded thereto so as to inhibit mechanical failure of the crust and collapse of the crust into the cavity.

2. The cell of claim 1, wherein at least one of said preformed refractory bodies is made of ceramic material.

3. The cell of claim 2, wherein said ceramic material comprises at least one of: oxides of aluminium, zirconium, tantalum, titanium, silicon, niobium, magnesium and calcium and mixtures thereof, as a simple oxide and/or in a mixed oxide, in particular aluminate of zinc or titanium; nitrides such as boron nitride, silicon nitride or aluminium nitride; carbides such as silicon carbide; borides such as aluminium boride; and oxycompounds, such as AlON, SiAlON, alkali earth metal zirconates and aluminates.

4. The cell of claim 1, wherein at least one of said preformed refractory bodies comprises a ceramic structure having an open porosity containing frozen electrolyte infiltrated into the structure.

5. The cell of claim 4, wherein at least one of said preformed refractory bodies is made substantially impervious to gas, in particular electrolyte vapours, by said infiltrated frozen electrolyte.

6. The cell of claim 4, wherein said infiltrated frozen electrolyte is made of a mixture containing aluminium fluoride and sodium fluoride, in particular a mixture having a melting point above 960° C.

7. The cell of claim 1, wherein the crust is supported by at least one of said preformed refractory bodies.

8. The cell of claim 7, wherein at least one of said preformed refractory bodies forms part of a means to suspend the self-formed electrolyte crust over the electrolyte.

9. The cell of claim 8, which has at least one sidewall by which at least one of said preformed refractory bodies is supported over the cavity.

10. The cell of claim 8, wherein at least one of said preformed refractory bodies is secured to a stem, in particular an anode stem, by which it is supported over the cavity.

11. The cell of claim 1, wherein at least one of said preformed refractory bodies is an elongated plate-like body.

12. The cell of claim 11, wherein said elongated plate-like body extends along a sidewall or centrally along the cavity.

13. The cell of claim 1, wherein the frozen electrolyte crust is spaced over the molten electrolyte surface by a gap.

14. A method of forming a crust on an electrolyte contained in an aluminium electrowinning cell as defined in claim 1, comprising providing at least one of said preformed refractory bodies, bringing said refractory body into contact with the surface of the electrolyte and freezing the surface of the electrolyte so as to form a crust in which the preformed refractory body is sealed for reinforcing the crust.

15. The method of claim 14, wherein at least one of said preformed refractory bodies is openly porous and infiltrated with frozen electrolyte before contacting the electrolyte contained in the cell, in particular with an electrolyte having a melting point above the electrolyte contained in the cell.

16. The method of claim 14, wherein at least one of said preformed refractory bodies is openly porous and infiltrated with electrolyte contained in the cell upon contact therewith.

17. The method of claim 16, wherein the electrolyte contained in the cell has a melting point that is lowered upon infiltration of said refractory body.

18. The method of claim 14, wherein upon formation of the crust, a gap is formed between the surface of the electrolyte and the crust, in particular by removing molten electrolyte upon formation of the crust thereon.

19. A method of producing aluminium comprising: providing an electrolyte in an aluminium electrowinning cell; forming a crust on the electrolyte by the method defined in any one of claims 14 to 18; supplying alumina to the electrolyte, in particular through the crust, where it is dissolved; electrolysing the dissolved alumina to produce gas anodically and aluminium cathodically; tapping product aluminium, in particular through a hole in the crust or in at least one of said preformed refractory bodies.

20. The method of claim 19, wherein oxygen is evolved anodically.

21. A trough for the electrowinning of aluminium from alumina dissolved in a fluoride-containing molten electrolyte, said trough having a cavity for containing the electrolyte, the electrolyte having a surface that has an expanse extending over the cavity and that is substantially covered by a self-formed crust of frozen electrolyte, wherein the crust is mechanically reinforced by at least one preformed refractory body having an openly porous structure infiltrated with frozen electrolyte, the electrolyte crust being formed against the preformed refractory body and bonded thereto so as to inhibit mechanical failure of the crust and collapse of the crust into the cavity, said openly porous structure comprising at lest one of: oxides of aluminium, zirconium, tantalum, titanium, silicon, niobium, magnesium and calcium and mixtures thereof, as a simple oxide and/or in a mixed oxide, in particular aluminate of zinc or titanium; nitrides such as boron nitride, silicon nitride or aluminium nitride; carbides such as silicon carbide; borides such as aluminium boride; and oxycompounds, such as AlON, SiAlON, alkali earth metal zirconates and aluminates.

22. A method of forming a crust on an electrolyte contained in a through as defined in claim 21, comprising providing at least one of said preformed refractory bodies, bringing said refractory body into contact with the surface of the electrolyte and freezing the surface of the electrolyte so as to form a crust in which the preformed refractory body is sealed for reinforcing the crust.

23. The method of claim 22, wherein at least one of said preformed refractory bodies is openly porous and infiltrated with frozen electrolyte before contacting the electrolyte contained in the cell, in particular with an electrolyte having a melting point above the electrolyte contained in the cell.

24. The method of claim 23, wherein at least one of said preformed refractory bodies is openly porous and infiltrated with electrolyte contained in the cell upon contact therewith.

25. The method of claim 23, wherein the electrolyte contained in the cell has a melting point that is lowered upon infiltration of said refractory body.

26. The method of claim 23, wherein upon formation of the crust, a gap is formed between the surface of the electrolyte and the crust, in particular by removing molten electrolyte upon formation of the crust thereon.

* * * * *